US007441924B1

(12) United States Patent
Thames et al.

(10) Patent No.: US 7,441,924 B1
(45) Date of Patent: Oct. 28, 2008

(54) LAMP WITH RETRACTABLE LAMP CORD

(75) Inventors: Tammie Thames, Pineville, LA (US); Marvin Zochert, Pineville, LA (US)

(73) Assignee: Tammie A. Thames, Pineville, LA (US)

( * ) Notice: Subject to any disclaimer, the term of this patent is extended or adjusted under 35 U.S.C. 154(b) by 0 days.

(21) Appl. No.: 11/811,256

(22) Filed: Jun. 8, 2007

(51) Int. Cl.
*F21V 27/00* (2006.01)

(52) U.S. Cl. ..... 362/258; 362/387; 362/410

(58) Field of Classification Search ..... 362/15, 362/258, 387, 389, 410
See application file for complete search history.

(56) References Cited

U.S. PATENT DOCUMENTS

| | | | | |
|---|---|---|---|---|
| 1,748,601 A | | 2/1930 | Gottlieb | 191/12.2 R |
| 1,946,128 A | | 2/1934 | Brosilow et al. | 240/81 |
| 1,947,517 A | | 2/1934 | Brosilow et al. | 240/81 |
| 1,982,854 A | | 12/1934 | Brosilow et al. | 240/81 |
| 2,014,301 A | | 9/1935 | Todd | 242/107 |
| 2,121,993 A | | 6/1938 | Stocks | 242/107 |
| 2,141,909 A | | 12/1938 | Hauser | 242/107 |
| 3,378,681 A | * | 4/1968 | Meyer et al. | 362/387 |
| 3,955,079 A | | 5/1976 | Chapman et al. | 240/70 |
| 5,101,082 A | * | 3/1992 | Simmons et al. | 191/12.2 R |
| 5,690,198 A | * | 11/1997 | Lohr | 191/12.2 R |

* cited by examiner

*Primary Examiner*—John A Ward
(74) *Attorney, Agent, or Firm*—R. Keith Harrison

(57) ABSTRACT

A lamp with a retractable lamp cord. An illustrative embodiment of the lamp with a retractable lamp cord includes a lamp base having a base interior; a lamp shaft extending from the lamp base; a light bulb socket provided on the lamp shaft; a rotatable cord spool provided in the base interior of the lamp base; a spring provided in the base interior of the lamp base and engaging the cord spool; first and second stator radial contacts provided in the base interior of the lamp base and electrically connected to the light bulb socket; rotatable first and second rotor radial contacts disposed in electrical contact with the first and second stator radial contacts, respectively; and a lamp cord electrically connected to the first and second rotor radial contacts and normally wound on the cord spool and extendable from the base interior of the lamp base.

20 Claims, 4 Drawing Sheets

LAMP WITH RETRACTABLE LAMP CORD

FIELD

The present invention relates to lamps. More particularly, the present invention relates to a lamp with a retractable lamp cord.

BACKGROUND

Electrical lamps for use in the interiors of homes and offices typically include a lamp base from which extends a lamp shaft. A light bulb socket is provided on the lamp shaft and receives a light bulb. A lamp shade is typically supported by the lamp shaft and surrounds the light bulb. A lamp cord fitted with an electrical outlet plug extends into the lamp base and is electrically connected to the light bulb socket.

The lamp cord of a conventional lamp is typically not extendable and retractable with respect to the lamp base, and therefore, has a fixed length. Thus, the length of the lamp cord is frequently either too long or too short to reach an electrical outlet when the lamp is situated at a desired position on a table or other support. Under circumstances in which the lamp cord is too long, excessive lengths of the cord are typically wound and secured using a twist-tie, rubber band or the like.

SUMMARY

The present invention is generally directed to a lamp with a retractable lamp cord. An illustrative embodiment of the lamp with a retractable lamp cord includes a lamp base having a base interior; a lamp shaft extending from the lamp base; a light bulb socket provided on the lamp shaft; a rotatable cord spool provided in the base interior of the lamp base; a spring provided in the base interior of the lamp base and engaging the cord spool; first and second stator radial contacts provided in the base interior of the lamp base and electrically connected to the light bulb socket; rotatable first and second rotor radial contacts disposed in electrical contact with the first and second stator radial contacts, respectively; and a lamp cord electrically connected to the first and second rotor radial contacts and normally wound on the cord spool and extendable from the base interior of the lamp base.

BRIEF DESCRIPTION OF THE DRAWINGS

The invention will now be described, by way of example, with reference to the accompanying drawings, in which.

DETAILED DESCRIPTION

Figure 1:
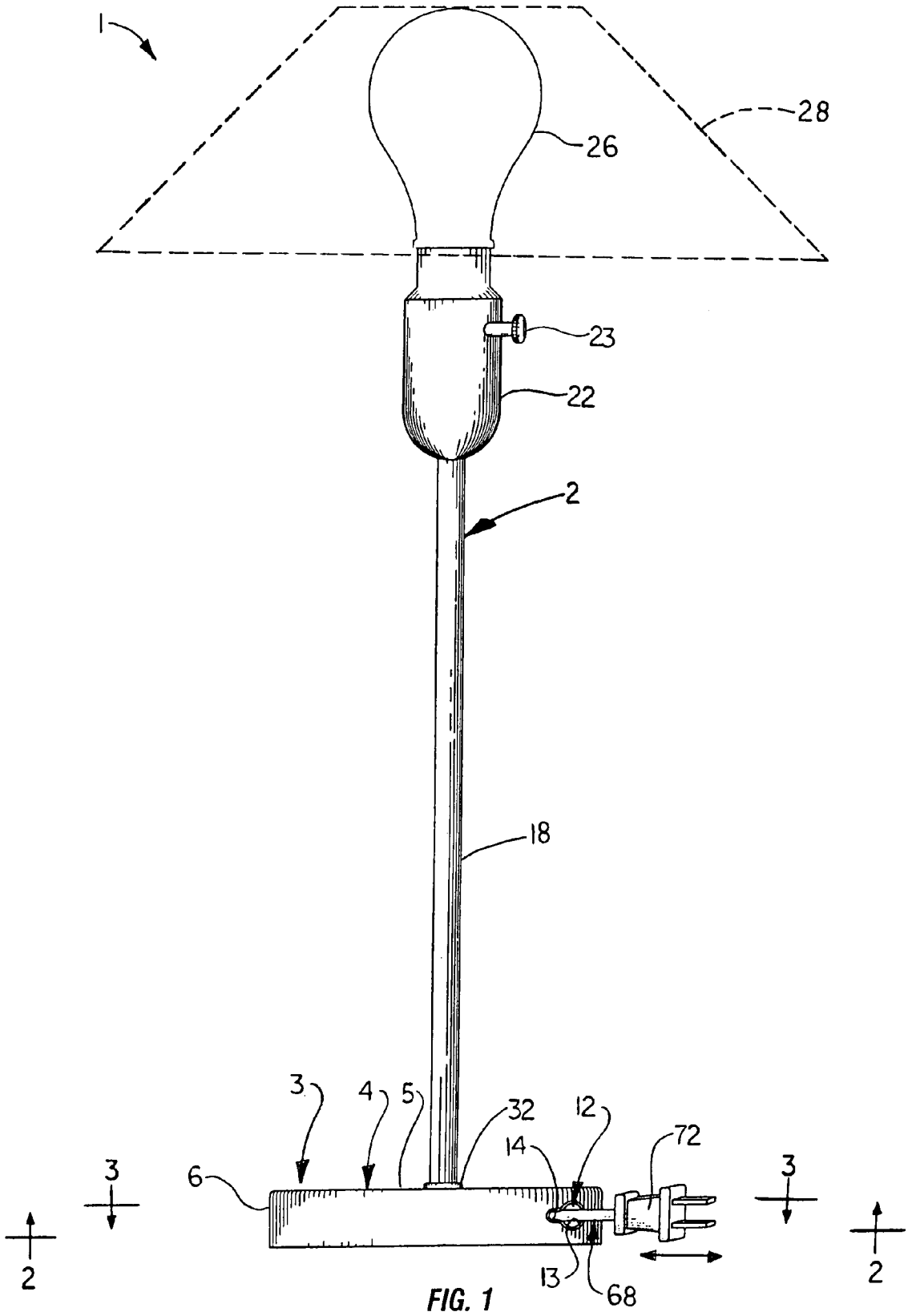
FIG. 1 is a front view of an illustrative embodiment of the lamp with retractable lamp cord.

Referring initially to FIG. 1 of the drawings, an illustrative embodiment of the lamp with retractable lamp cord, hereinafter lamp, is generally indicated by reference numeral 1. The lamp 1 includes a lamp assembly 2 having a lamp base 3 and a lamp shaft 18 which extends from the lamp base 3. A lamp cord 68, which terminates in an electrical outlet plug 72, is selectively extendable and retractable with respect to the lamp base 3 typically in a manner which will be hereinafter described. A light bulb socket 22 is provided on the lamp shaft 18. The light bulb socket 22 is adapted to receive a light bulb 26 typically in the conventional threaded manner. In some embodiments, a light switch 23 extends from the light bulb socket 22 to facilitate selective turning of the light bulb 26 on and off responsive to rotation of the light switch 23, according to the knowledge of those skilled in the art. In other embodiments, a pull chain (not illustrated) extends from the light bulb socket 22 to facilitate selective turning of the light bulb 26 on and off responsive to pulling of the pull chain in a manner which is known by those skilled in the art. In still other embodiments, a cord switch (not illustrated) is provided in the lamp cord 68 to facilitate selective turning of the light bulb 26 on and off responsive to manipulation of the cord switch in a manner which is known by those skilled in the art. It will be appreciated by those skilled in the art that any of a variety of alternative mechanisms, including remote-controlled mechanisms, in non-exclusive particular, can be used to facilitate selective flow of electrical power to the light bulb socket 22 and the light bulb 26. A lamp shade 28 (shown in phantom) is typically provided on the lamp assembly 2 and at least partially surrounds the light bulb 26.

Figure 6:
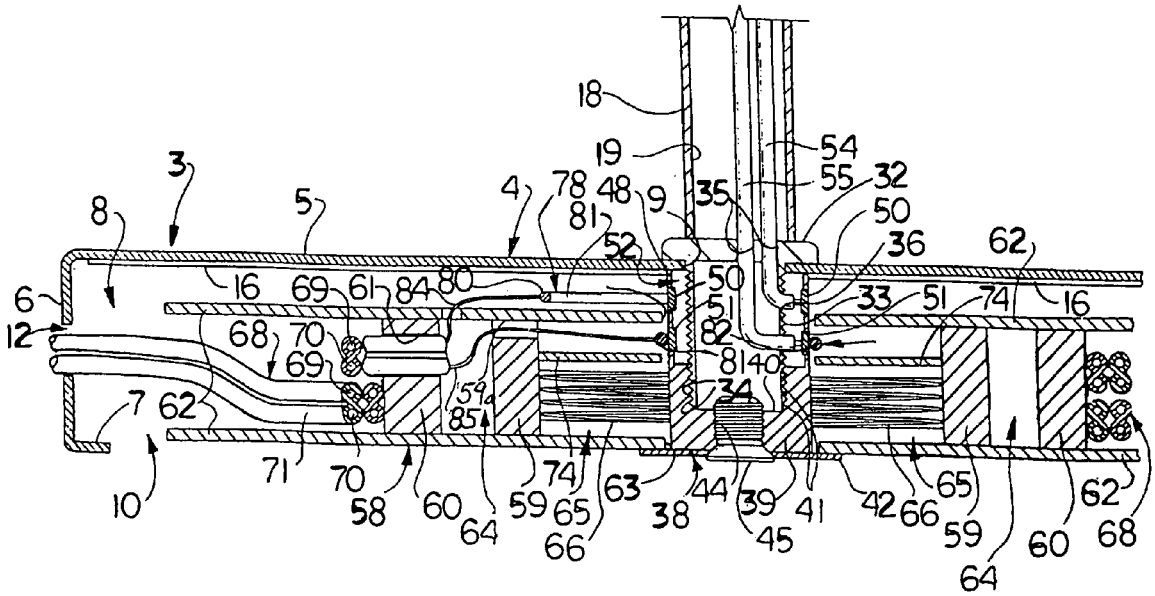
FIG. 6 is a cross-sectional view of the lamp base of an illustrative embodiment of the lamp with retractable lamp cord, with the lamp cord (partially in section) partially extended from the lamp base.

Referring next to FIG. 6 of the drawings, the lamp base 3 includes a base housing 4 which may have an upper base wall 5 and a side base wall 6 which extends from the upper base wall 5. In some embodiments, a bottom base flange 7 extends inwardly from the side base wall 6, in spaced-apart relationship with respect to the upper base wall 5. In some embodiments the lamp base 3 is generally cylindrical, with the upper base wall 5 having a generally circular shape; the side base wall 6 having a generally cylindrical shape; and the bottom base flange 7 having a generally annular shape. The base housing 4 of the lamp base 3 has a base interior 8. A bottom base opening 10 is defined by the bottom base flange 7 and communicates with the base interior 8. In some embodiments, a bottom base wall (not illustrated), rather than the bottom base flange 7, extends from the side base wall 6 and closes the bottom base opening 10. An electrical insulator 16, which is, typically an annular electrically-insulating material such as acetate, for example, may be provided on the interior surface of the upper base wall 5.

The lamp shaft 18 may be attached to the lamp base 3 using any suitable technique which is known by those skilled in the art. As illustrated in FIG. 6, in some embodiments a shaft base 32 is provided on the lamp base 3. The lamp shaft 18 extends from and may be welded and/or otherwise attached to the shaft base 32 according to the knowledge of those skilled in the art. In some embodiments, the lamp shaft 18 is formed integrally with the shaft base 32. The lamp shaft 18 has a shaft interior 19. At least one wiring opening 35 extends through the shaft base 32 and communicates with the lamp shaft interior 19 for purposes which will be hereinafter described.

The shaft base 32 may be attached to the base housing 4 of the lamp base 3 using any suitable technique which is known by those skilled in the art. As further illustrated in FIG. 6, in some embodiments a sleeve opening 9 extends through the upper base wall 5 of the base housing 4. A cylindrical shaft base sleeve 33 extends from the shaft base 32 and inserts through the sleeve opening 9. A clamp nut 38 includes a clamp nut body 39 having a sleeve cavity 40 which receives the shaft base sleeve 33. Cavity threads 41 are typically provided on the interior surface of the sleeve cavity 40 and mate with companion sleeve threads 34 provided on the exterior surface of the shaft base sleeve 33 to attach the clamp nut 38 to the shaft base sleeve 33. A cylindrical nut sleeve 48 extends from the clamp nut body 39 of the clamp nut 38 and encircles the shaft base sleeve 33. An annular contact space 52 is defined between the shaft base sleeve 33 and the nut sleeve 48. At least one wiring opening 36 extends through the shaft base sleeve 33 and communicates with the contact space 52 for purposes which will be hereinafter described.

An interiorly-threaded screw opening 44 extends through the clamp nut body 39 of the clamp nut 38. A holding screw 45 is threaded into the screw opening 44. A washer 42 is typically interposed between the holding screw 45 and the clamp nut body 39 of the clamp nut 38 for purposes which will be hereinafter described.

A first stator radial contact 50 and a second stator radial contact 51 are provided on the nut sleeve 48, in spaced-apart relationship with respect to each other. Each of the first stator radial contact 50 and the second stator radial contact 51 is an electrically conductive material such as copper, for example, and may have a generally annular shape. The first stator radial contact 50 and the second stator radial contact 51 are electrically insulated from each other.

A first light socket wiring 54 electrically connects the light bulb socket 22 (FIG. 1) of the lamp assembly 2 to the first stator radial contact 50. A second light socket wiring 55 electrically connects the light bulb socket 22 of the lamp assembly 2 to the second stator radial contact 51. The first light socket wiring 54 and the second light socket wiring 55 extend through the lamp shaft interior 19 of the lamp shaft 18, the at least one wiring opening 35 in the shaft base 32 and the at least one wiring opening 36 in the shaft base sleeve 33, respectively. The first light socket wiring 54 and the second light socket wiring 55 may be attached to the first stator radial contact 50 and the second stator radial contact 51, respectively, in the contact space 52 using soldering or other suitable technique which is known by those skilled in the art.

Figure 2:
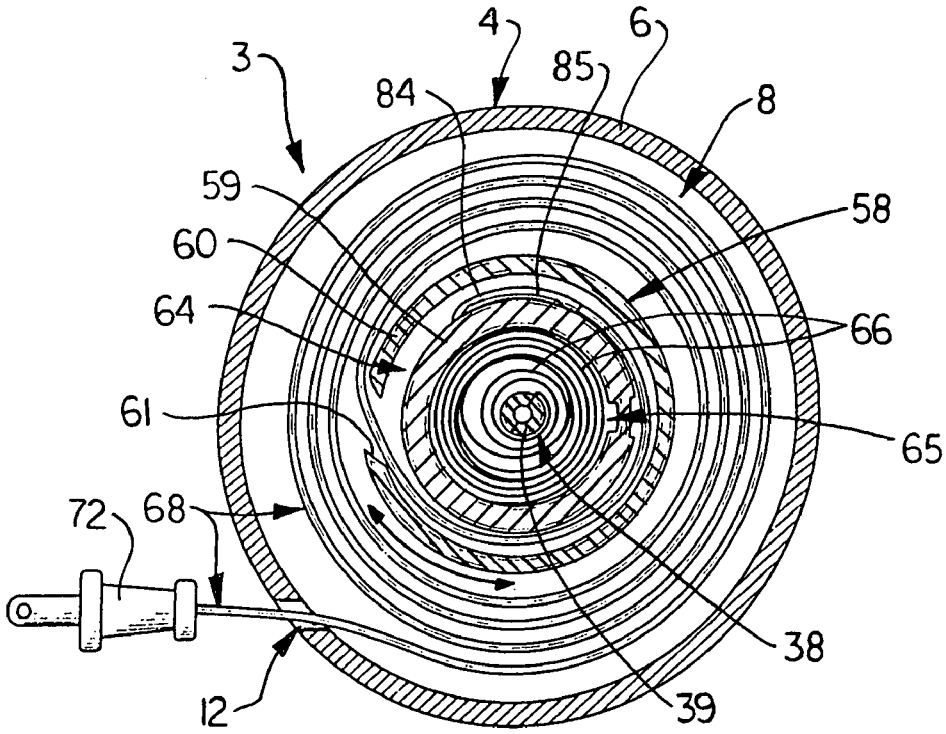
FIG. 2 is a sectional view, taken along section lines 2-2 in FIG. 1, of a lamp base component of an illustrative embodiment of the lamp with retractable lamp cord.
Figure 3:
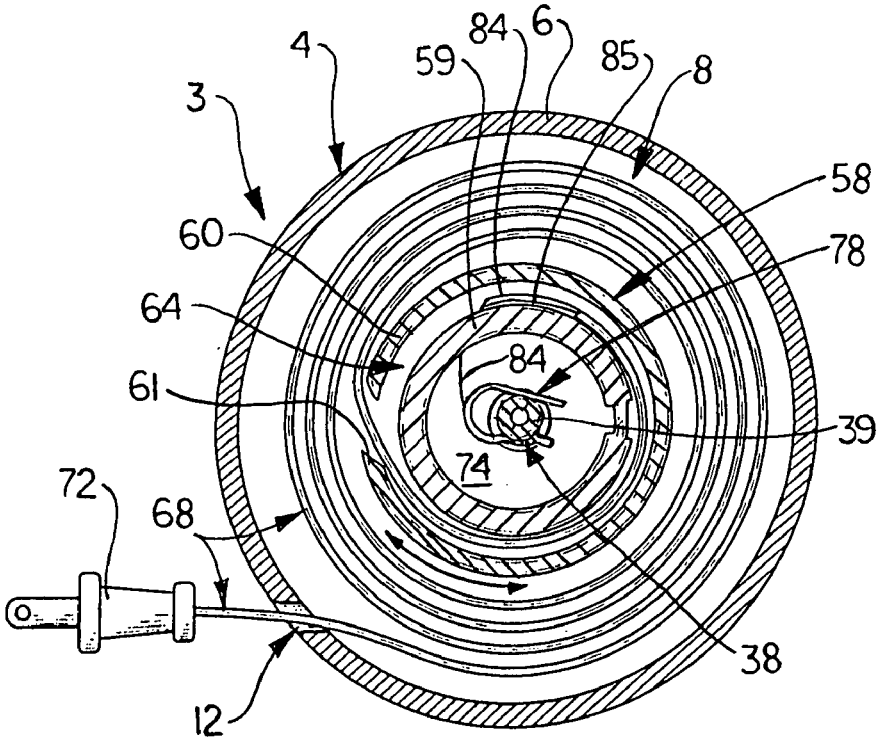
FIG. 3 is a sectional view, taken along section lines 3-3 in FIG. 1, of a lamp base component of an illustrative embodiment of the lamp with retractable lamp cord.

Referring next to FIGS. 2, 3 and 6 of the drawings, a rotatable cord spool 58 is provided in the base interior 8 of the base housing 4. As illustrated in FIG. 6, the cord spool 58 includes a pair of spaced-apart, annular spool flanges 62. Each spool flange 62 has a central sleeve opening 63 which is disposed in general alignment with respect to the sleeve opening 63 of the other spool flange 62. An inner spool hub 59 and an outer spool hub 60, each of which is annular, extends between the spool flanges 62 in spaced-apart relationship with respect to each other. The clamp nut body 39 and the nut sleeve 48 of the clamp nut 38 extend through the sleeve openings 63 of the respective spool flanges 62.

A wiring connection compartment 64 is defined between the inner spool hub 59 and the outer spool hub 60. As illustrated in FIGS. 2 and 6, a spring compartment 65 is defined between the clamp nut 38 and the inner spool hub 59 of the cord spool 58. As illustrated in FIG. 6, the washer 42 engages an adjacent spool flange 62 of the cord spool 58. Accordingly, the cord spool 58 is capable of freely rotating with respect to the clamp nut 38 in the base interior 8. A wiring opening **59*a* extends through the inner spool hub 59 and establishes communication between the wiring connection compartment 64 and the spring compartment 65. A cord opening 61 extends through the outer spool hub 60 and communicates with the wiring connection compartment 64. An annular electrical insulator 74, which is an electrically-insulating material such as acetate, for example, may extend from the inner spool hub 59, as shown, or from the clamp nut 38 into the spring compartment 65. The purpose of the wiring opening 59*a* and the cord opening 61** will be hereinafter described.

As illustrated in FIGS. 2 and 6, a spring 66 is provided in the spring compartment 65 and is attached to the clamp nut body 39 of the clamp nut 38 and the inner spool hub 59 of the cord spool 58 according to the knowledge of those skilled in the art. Accordingly, upon rotation of the cord spool 58 with respect to the clamp nut 38 in a first clockwise or counterclockwise direction in the base interior 8, the spring 66 is tensioned. Upon release of the cord spool 58, the spring 66 recoils and rotates the cord spool 58 in the opposite or second, counterclockwise or clockwise direction in the base interior 8.

Figure 7:
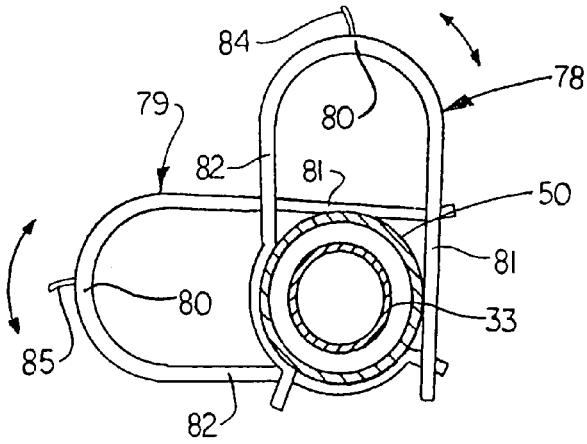
FIG. 7 is a cross-sectional view of a stator radial contact element of the lamp base, with a rotor radial contact rotatably engaging the stator radial contact.

A first rotor radial contact 78 is disposed in electrical contact with the first stator radial contact 50. A second rotor radial contact 79 is disposed in electrical contact with the second stator radial contact 51. The first rotor radial contact 78 and the second rotor radial contact 79 are rotatable with respect to the first stator radial contact 50 and the second stator radial contact 51, respectively. As illustrated in FIG. 7, in some embodiments, each of the first rotor radial contact 78 and the second rotor radial contact 79 includes a generally curved segment 80 from which extends a pair of generally elongated contact segments 81, 82. The contact segments 81, 82 of the first rotor radial contact 78 engage opposite sides of the first stator radial contact 50, as illustrated in FIG. 7, whereas the contact segments 81, 82 of the second rotor radial contact 79 engage opposite sides of the second stator radial contact 51, as illustrated in FIG. 6.

A first contact wiring 84 is disposed in electrical communication with and extends from the first rotor radial contact 78, such as the curved segment 80 thereof, for example. A second contact wiring 85 is disposed in electrical communication with and extends from the second rotor radial contact 79, such as the curved segment 80 thereof, for example. As illustrated in FIG. 6, the first contact wiring 84 typically extends from the first rotor radial contact 78 through a wiring opening (not numbered), which is provided in a spool flange 62 of the cord spool 58, and into the wiring connection compartment 64. The second contact wiring 85 typically extends from the second rotor radial contact 79 through the wiring opening **59*a*, which is provided in the inner spool hub 59, and into the wiring connection compartment 64**.

Figure 4:
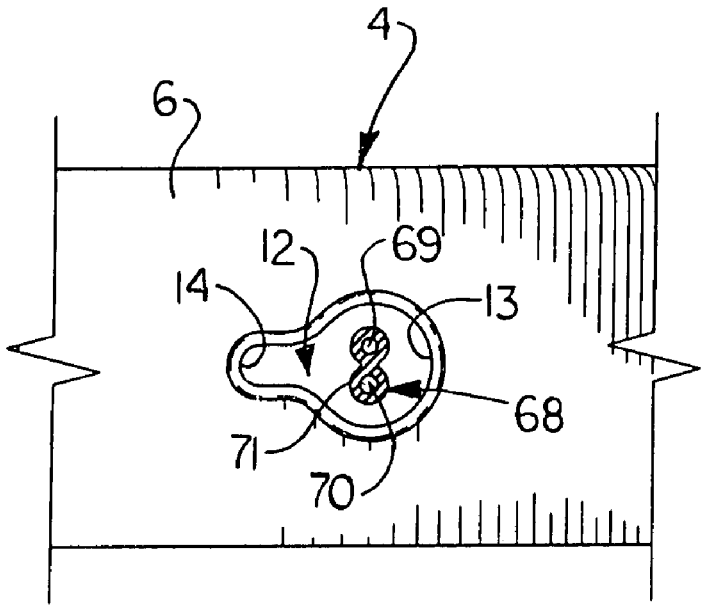
FIG. 4 is a side view, partially in section, of a portion of the lamp base, more particularly illustrating an exemplary cord opening provided in the lamp base and a lamp cord (shown in section) extending through a main portion of the cord opening to facilitate extension and retraction of the lamp cord with respect to the lamp base.
Figure 5:
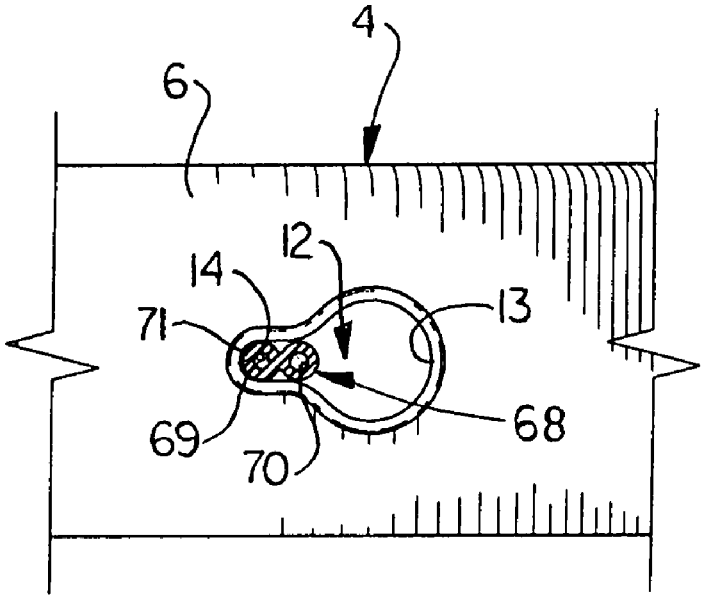
FIG. 5 is a side view, partially in section, of a portion of the lamp base, more particularly illustrating the exemplary cord opening provided in the lamp base and the lamp cord (shown in section) extending through a cord lock portion of the cord opening to prevent extension and retraction of the lamp cord with respect to the lamp base after extension of a selected length of the lamp cord from the lamp base.

As illustrated in FIGS. 4-6, the lamp cord 68 typically includes a first cord wiring 69 and a second cord wiring 70 which are sheathed in electrical cord insulation 71, typically plastic or rubber. As illustrated in FIG. 6, a proximal end of the lamp cord 68 extends through the cord opening 61 provided in the outer spool hub 60 of the cord spool 58. The lamp cord 68 is friction-fitted in the cord opening 61 and/or secured therein using adhesives and/or other securing technique which is known by those skilled in the art. The first contact wiring 84 is electrically connected to the first cord wiring 69, whereas the second contact wiring 85 is electrically connected to the second cord wiring 70, of the lamp cord 68. The first contact wiring 84 and the second contact wiring 85 may be continuous with the first cord wiring 69 and the second cord wiring 70, respectively.

A cord opening 12 is provided in the base housing 4 of the lamp base 3. As further illustrated in FIG. 6, the lamp cord 68 is wound on the outer spool hub 60 of the cord spool 58 and extends through the cord opening 12. Accordingly, the lamp cord 68 can be selectively extended from the lamp base 3 through the cord opening 12 as the lamp cord 68 is unwound from the cord spool 58 and the cord spool 58 rotates in a first clockwise or counterclockwise direction in the base interior 8. Simultaneously, the spring 66 is tensioned between the clamp nut 38 and the inner spool hub 59 of the cord spool 58. The lamp cord 68 can be released such that the tensioned spring 66 recoils and rotates the cord spool 58 in the opposite counterclockwise or clockwise direction as the lamp cord 68 is again wound on the outer spool hub 60 of the cord spool 58 and retracted through the cord opening 12.

As the cord spool 58 rotates in the clockwise or counterclockwise direction in the base interior 8, the first stator radial contact 50 and the second stator radial contact 51 are stationary. As the lamp cord 68 is extended from the lamp base 3 and unwound from the cord spool 58, causing rotation of the cord spool 58 in the first clockwise or counterclockwise direction with respect to the clamp nut 38, the first rotor radial contact 78 and the second rotor radial contact 79 rotate with respect to the first stator radial contact 50 and the second stator radial contact 51, respectively, in the first clockwise or counterclockwise direction. Upon release of the lamp cord 68, as the cord spool 58 rotates in the second counterclockwise or clockwise direction with respect to the clamp nut 38 and the lamp cord 68 is retracted into the lamp base 3 and wound on the cord spool 58, the first rotor radial contact 78 and the second rotor radial contact 79 rotate with respect to the first stator radial contact 50 and the second stator radial contact 51, respectively, in the second counterclockwise or clockwise direction. The first rotor radial contact 78 and the second rotor radial contact 79 remain in electrical contact with the first stator radial contact 50 and the second stator radial contact 51, respectively, throughout rotation of the first rotor radial contact 78 and the second rotor radial contact 79.

In some embodiments, the cord opening 12 extends through the side base wall 6 of the base housing 4, as illustrated in FIG. 6. However, it will be understood that the cord opening 12 may be provided in any suitable alternative location or element in the base housing 4. As illustrated in FIGS. 4 and 5, in some embodiments the cord opening 12 includes a main portion 13, which may be generally circular, and a cord lock portion 14 which extends from the main portion 13. The cord lock portion 14 is narrower than the main portion 13 of the cord opening 12 and slightly narrower than the thickness of the lamp cord 68. As illustrated in FIG. 4, as it is being extended from or retracted into the lamp base 3, the lamp cord 68 is located in the main portion 13 of the cord opening 12. Accordingly, the width or diameter of the main portion 13 is sufficient to facilitate free passage of the lamp cord 68 through the cord opening 12 during extension and retraction of the lamp cord 68 with respect to the lamp base 3. When it is desired to secure a selected length of the lamp cord 68 with respect to the lamp base 3, the lamp cord 68 is inserted and friction-fitted into the cord lock portion 14 of the cord opening 12 to prevent passage of the lamp cord 68 through the cord opening 12 and retraction of the lamp cord 68 into the lamp base 3.

In typical use of the lamp 1, the lamp base 3 is placed on a table or other suitable support (not illustrated). The lamp cord 68 is normally retracted into the base interior 8 of the lamp base 3 by actuation of the spring 66 (FIGS. 2 and 6) against the cord spool 58. In the retracted configuration of the lamp cord 68, the electrical outlet plug 72 typically engages the exterior surface of the lamp base 3, against the cord opening 12 in the side base wall 6. When it is desired to plug the lamp 1 into an electrical outlet (not illustrated), the lamp cord 68 is extended from the base interior 8 through the main portion 13 of the cord opening 12, as illustrated in FIG. 4. Accordingly, the cord spool 58 rotates in the first, unwinding clockwise or counterclockwise direction in the base interior 8 as the lamp cord 68 is unwound from the outer spool hub 60 of the cord spool 58. Extension of the lamp cord 68 from the lamp base 3 is continued until the length of the extended lamp cord 68 is sufficient for insertion of the electrical outlet plug 72 into the electrical outlet. When this selected length of the lamp cord 68 has been extended from the lamp base 3, the segment of the lamp cord 68 which extends through the cord opening 12 is inserted into the cord lock portion 14 of the cord opening 12, as illustrated in FIG. 5, to "lock" the lamp cord 68 with respect to the lamp base 3 and prevent further extension and retraction of the lamp cord 68 with respect to the lamp base 3.

The light bulb 26 (FIG. 1) on the lamp assembly 2 is energized typically by actuation of the light switch 23 on the light bulb socket 22. Accordingly, the light switch 23 is manipulated to facilitate flow of electrical power between the electrical outlet plug 72 and the light bulb socket 22, for illumination of the light bulb 26, through the first cord wiring 69 and second cord wiring 70 of the lamp cord 68; the first contact wiring 84 and second contact wiring 85 (FIG. 6); the first rotor radial contact 78 and second rotor radial contact 79; the first stator radial contact 50 and second stator radial contact 51; and the first light socket wiring 54 and second light socket wiring 55, respectively. It will be appreciated by those skilled in the art that while the first rotor radial contact 78 and the second rotor radial contact 79 rotate with respect to the first stator radial contact 50 and the second stator radial contact 51, respectively, as the lamp cord 68 is extended and retracted through the cord opening 12 with respect to the lamp base 3 and the cord spool 58 rotates in the lamp base 3, the first rotor radial contact 78 and the second rotor radial contact 79 remain in continuous electrical communication with the first stator radial contact 50 and the second stator radial contact 51, respectively. Therefore, the electrical outlet plug 72 remains in electrical communication with the light bulb socket 22 no matter the length or degree of extension of the lamp cord 68 from the lamp base 3. The lamp cord 68 can be selectively retracted into the lamp base 3 by relocating the lamp cord 68 from the cord lock portion 14 into the main portion 13 of the cord opening 12 and allowing the cord spool 58 to rotate in the second counterclockwise or clockwise direction in the base interior 8, under actuation of the spring 66, until the lamp cord 68 is wound on the outer spool hub 60 of the cord spool 58.

While the preferred embodiments of the invention have been described above, it will be recognized and understood that various modifications can be made in the invention and the appended claims are intended to cover all such modifications which may fall within the spirit and scope of the invention.

What is claimed is:

1. A lamp, comprising:

a lamp base having a base interior;

a lamp shaft extending from said lamp base;

a light bulb socket provided on said lamp shaft;

a rotatable cord spool provided in said base interior of said lamp base;

a spring provided in said base interior of said lamp base and engaging said cord spool;

first and second stator radial contacts provided in said base interior of said lamp base and electrically connected to said light bulb socket;

rotatable first and second rotor radial contacts disposed in electrical contact and coplanar relationship with said first and second stator radial contacts, respectively; and a lamp cord electrically connected to said first and second rotor radial contacts and normally wound on said cord spool and extendable from said base interior of said lamp base.

2. The lamp of claim 1 further comprising a cord opening provided in said lamp base and wherein said lamp cord extends through said cord opening.

3. The lamp of claim 2 wherein said cord opening comprises a main portion and a cord lock portion extending from said main portion and narrower than said main portion.

4. The lamp of claim 1 wherein said lamp base includes a base housing having a generally cylindrical configuration.

5. The lamp of claim 4 wherein said base housing comprises a generally circular upper base wall and a generally cylindrical side base wall extending from said upper base wall.

6. The lamp of claim 5 further comprising a generally annular bottom base flange extending from said side base wall and a bottom base opening defined by sail bottom base flange.

7. The lamp of claim 1 wherein each of said first stator radial contact and said second stator radial contact has a generally annular shape.

8. The lamp of claim 1 further comprising a first light socket wiring connecting said first stator radial contact to said light bulb socket and a second light socket wiring connecting said second stator radial contact to said light bulb socket.

9. A lamp, comprising:

a lamp base including a base housing having a base interior and a sleeve opening provided in said base housing;

a shaft base carried by said base housing;

a shaft base sleeve extending from said shaft base through said sleeve opening a clamp nut having a clamp nut body engaging said shaft base sleeve and a nut sleeve extending from said clamp nut body;

a lamp shaft extending from said lamp base;

a rotatable cord spool provided in said base interior of said lamp base and laving a pair of sleeve openings receiving said clamp nut;

a spring provided in said base interior of said lamp base and engaging said clamp nut and said cord spool;

first and second stator radial contacts provided on said nut sleeve of said clamp nut in said base interior of said lamp base and electrically connected to said light bulb socket;

independently rotatable first and second rotor radial contacts disposed in electrical contact and coplanar relationship with said first and second stator radial contacts respectively; and a lamp cord electrically connected to said first and second rotor radial contacts and normally wound on said cord spool and extendable from said base interior of said lamp base.

10. The lamp of claim 9 wherein said cord spool comprises a pair of spaced-apart spool flanges and at least one spool hub extending between said spool flanges.

11. The lamp of claim 10 wherein said at least one spool hub comprises an inner spool hub and an outer spool hub.

12. The lamp of claim 11 further comprising a spring compartment between said clamp nut and said inner spool hub and wherein said spring is provided in said spring compartment and engages said inner spool hub.

13. The lamp of claim 11 further comprising a wiring connection compartment between said inner spool hub and said outer spool hub and wherein said lamp cord is electrically connected to said first rotor radial contact and said second rotor radial contact in said wiring connection compartment.

14. The lamp of claim 13 further comprising a first contact wiring connecting said lamp cord to said first rotor radial contact and a second contact wiring connecting said lamp cord to said second rotor radial contact.

15. The lamp of claim 14 further comprising a first wiring opening provided in one of said spool flanges and a second wiring opening provided in said inner spool hub, and wherein said first contact wiring extends through said first wiring opening and said second contact wiring extends through said second wiring opening.

16. The lamp of claim 9 wherein said first rotor radial contact and said second rotor radial contact each comprises a generally curved segment and a pair of generally elongated contact segments extending from said curved segment.

17. A lamp, comprising:

a lamp base including a base housing having a base interior;

a lamp shaft extending from said base housing of said lamp base;

a light bulb socket provided on said lamp shaft;

a rotatable cord spool provided in said base interior of said lamp base;

a spring provided in said base interior of said base housing and engaging said cord spool;

generally annular first and second stator radial contacts provided in said base interior of said lamp base and electrically connected to said light bulb socket;

independently rotatable first and second rotor radial contacts disposed in electrical contact and coplanar relationship with said first and second stator radial contacts, respectively:

wherein each of said first and second rotor radial contacts includes a generally curved segment and a pair of generally elongated, spaced-apart contact segments extending from said curved segment and engaging opposite diametrically-opposed sides of said first and second stator radial contacts, respectively; and a lamp cord electrically connected to said first and second rotor radial contacts and normally wound on said cord spool and extendable from said base interior of said lamp base.

18. The lamp of claim 17 further comprising a cord opening provided in said lamp base and wherein said lamp cord extends through said cord opening.

19. The lamp of claim 18 wherein said cord opening comprises a main portion and a cord lock portion extending from said main portion and narrower than said main portion.

20. The lamp of claim 17 wherein said cord spool comprises a pair of spaced-apart spool flanges and at least one spool hub extending between said spool flanges, and wherein said lamp cord is normally wound on said at least one spool hub and said spring engages said at least one spool hub.

* * * * *